US005741126A

United States Patent [19]

Stearns et al.

[11] Patent Number: 5,741,126

[45] Date of Patent: Apr. 21, 1998

[54] VALVELESS METERING PUMP WITH CRISSCROSSED PASSAGE WAYS IN THE PISTON

[76] Inventors: Stanley D. Stearns, P.O. Box 55603, Houston, Tex. 77255; Paul Werner, Moosgasse 6, CH-6210 Sursee, Switzerland

[21] Appl. No.: 609,849

[22] Filed: Mar. 1, 1996

[51] Int. Cl.[6] ..... F04B 7/04

[52] U.S. Cl. ..... 417/490; 417/498; 417/500

[58] Field of Search ..... 417/490, 498, 417/500

[56] References Cited

U.S. PATENT DOCUMENTS

| | | | |
|---|---|---|---|
| 1,238,939 | 9/1917 | Pfleeger . | |
| 1,866,217 | 7/1932 | Mayer | 417/500 |
| 3,447,468 | 6/1969 | Kinne . | |
| 4,941,809 | 7/1990 | Pinkerton . | |
| 5,015,157 | 5/1991 | Pinkerton et al. . | |
| 5,020,980 | 6/1991 | Pinkerton . | |
| 5,044,889 | 9/1991 | Pinkerton . | |
| 5,158,441 | 10/1992 | Aid et al. . | |
| 5,246,354 | 9/1993 | Pardinas . | |
| 5,279,210 | 1/1994 | Pinkerton . | |
| 5,312,233 | 5/1994 | Tanny et al. . | |
| 5,494,420 | 2/1996 | Mawhirt et al. | 417/500 |
| 5,613,839 | 3/1997 | Buckley | 417/498 |

OTHER PUBLICATIONS

401–95 Fluid Metering, Inc. catalog entitled Valveless Metering Pumps Jan. 1995.

*Primary Examiner*—Timothy Thorpe
*Assistant Examiner*—Cheryl J. Tyler
*Attorney, Agent, or Firm*—Gunn & Associates, P.C.

[57] ABSTRACT

A valveless positive displacement pump with a closed end cylinder has fluid inlet and outlet ports adjacent to the closed end. A piston is reciprocally and rotatively driven in the cylinder. The piston is provided with crisscrossed helical slots formed thereon which communicate specifically with the inlet and outlet ports for pumping fluid through the positive displacement pump. The piston is rotated by a drive shaft connected to a motor and reciprocated by an cam actuator mechanism cooperating with the drive shaft.

19 Claims, 2 Drawing Sheets

12
70
74
66
20
64
13
72
80
78
76
122
82
120
68
106
104
94
62
112
92
114
108
116
102
16
110
98
118
103
96
114
100
90
60
104
106
132
130
140
138
136
26
142
134
144
68
18
40
34
28
22
10
32
30
52
42
44
14
36
46
24
48
54
55
38
50

126
84
124
103
132
142
140

FIG. 2
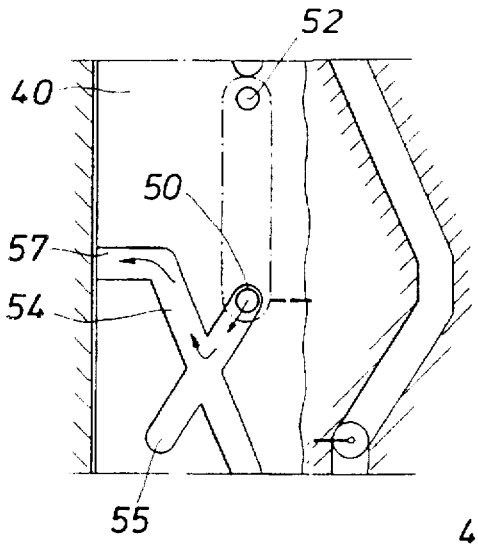
FIG. 3
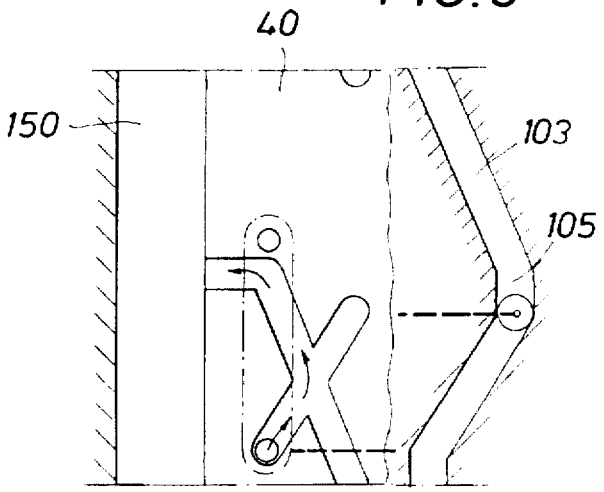
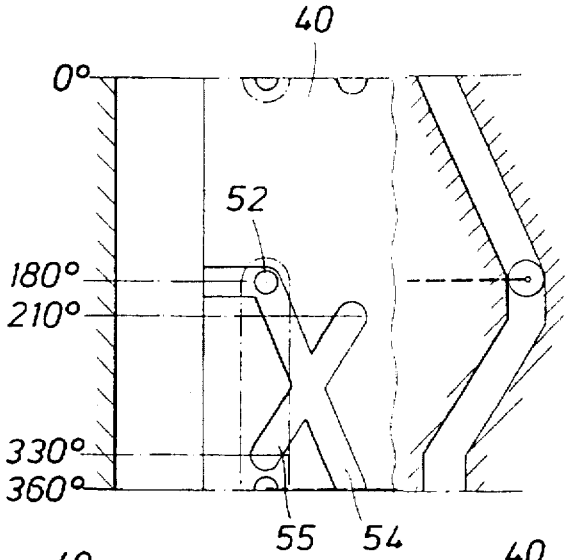
FIG. 4
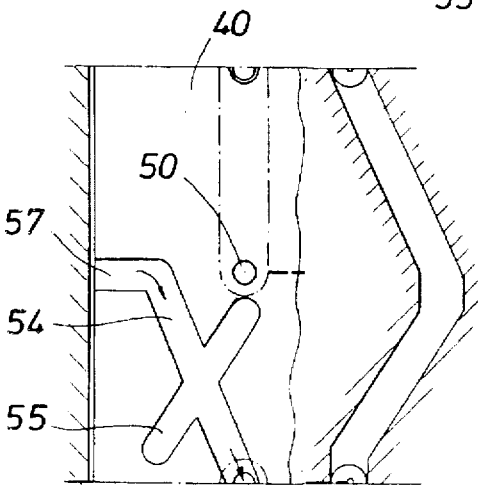
FIG. 5
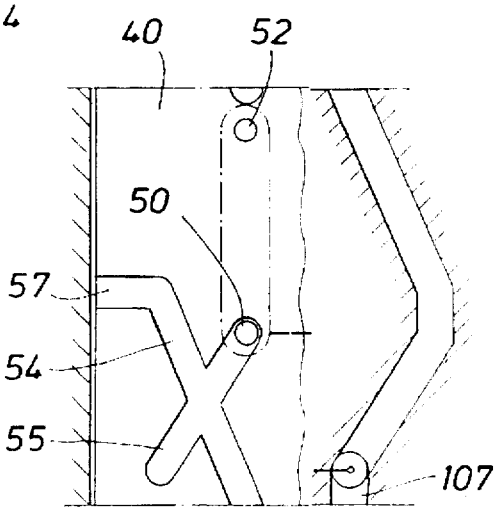
FIG. 6

VALVELESS METERING PUMP WITH CRISSCROSSED PASSAGE WAYS IN THE PISTON

BACKGROUND OF THE DISCLOSURE

The present invention relates generally to positive displacement pumps, particularly, to metering pumps for dispensing relatively precise volumes of fluid from a source to a receiver at accurately controlled rates and volume through the use of a valveless positive displacement piston pump coupled to a precision rotary/linear motion actuator mechanism.

Valveless, positive displacement metering pumps have been successfully employed in many applications where safe and accurate handling of fluids is required. Several such pumps are discussed in U.S. Pat. No. 5,020,980 to Pinkerton. As noted by Pinkerton, the valveless pumping function is accomplished by the synchronous rotation and reciprocation of a piston in a precisely mated cylinder bore. One pressure and one suction stroke are completed per cycle. A slot on the piston connects a pair of cylinder ports alternately with the pumping chamber. One port is in fluid communication with the pumping chamber on the pressure stroke and the other port is in fluid communication with the pumping chamber on the suction stroke. The piston and cylinder form a valveless positive displacement pump. These types of pumps have been found to perform accurate transfers of both gaseous and liquid fluids. In numerous types of fluid systems, the intermixing of fluids must be controlled to a high degree of accuracy. In one such system, a pump head module containing the piston and cylinder is mounted in a manner that permits it to be swiveled angularity with respect to the rotating drive member. The degree of angle controls the stroke length and in turn flow rate. The direction Of the angle controls flow direction.

The manner in which the pump head module is swiveled with respect to the drive member varies among the different available metering pumps. In one commercially available pump, the pump head module is secured to a plate which is, in turn, mounted to the base of the pump. The plate is pivotal about one of two pivot axes depending upon the angular orientation of the module. The base may be provided with graduations to indicate the percentage of the maximum flow rate achieved at the particular angle at which the module is directed. Maximum flow rate is achieved when the module is at its maximum angle with respect to the axis of the rotating drive member.

In such a metering pump, the piston rotates and reciprocates. The piston is provided with a flat or slot which extends to the end of the piston. As the piston is pulled back and rotated, the piston slot opens to the inlet port, thereby creating suction which fills the pump chamber with fluid. As the piston reaches the highest point in the reciprocation cycle, the pump chamber is at its maximum volume capacity. Continuing the piston rotation seals the inlet port. As the inlet port is sealed and the pump chamber is full to its maximum volume capacity, the outlet port opens up. Continuing the rotation and reciprocation, the piston is forced down and the piston slot opens to the outlet port. Discharge is created and fluid is pumped out of the pump chamber. The piston bottoms at the end of the pressure stroke for maximum fluid and bubble clearing. Continuation of piston rotation seals the outlet port. When the outlet port is sealed and the pump chamber is empty, the inlet port opens to start another suction stroke.

While positive displacement pumps have the capability of providing precise delivery of fluids, numerous potential problems may be encountered. For example, available positive displacement pumps may leak, may not self align, may jam due to the build up of solids and may be inaccurate due to air bubble build up in the piston slot. In addition, pressure build up in the pump chamber at the end of each piston pressure stroke due to axial travel of the piston at the transition point between the inlet and outlet ports, may induce leakage about the piston and provide a fluid communication flow path between the inlet and outlet ports.

It is therefore an object of the present invention to provide a rotary reciprocating positive displacement pump utilizing a rotary reciprocating piston as an integral valving mechanism in which the axial stroke length of the rotary piston may be precisely controlled by a cam drive mechanism.

It is a further object of the invention to provide a rotary reciprocating pump in which axial piston movement is interrupted during piston rotation so that only one fluid port is open at any given time thereby the pressure and suction ports are never interconnected.

It is yet a further object of the invention to provide a rotary reciprocating pump wherein the pump may be flushed upon a single rotation of the piston.

These and other advantages and features of the present invention will be apparent to those of skill in the art when they read the following detailed description along with the accompanying drawing figures.

SUMMARY OF THE INVENTION

In general, the present invention contemplates a valveless positive displacement pump with a closed end cylinder having fluid inlet and outlet ports adjacent to the closed end. A piston is reciprocally and rotatively driven in the cylinder. The piston is provided with crossover slots formed thereon which communicate specifically with the inlet and outlet ports for pumping fluid through the positive displacement pump. The piston is rotated by a drive shaft connected to a motor and reciprocated by an cam actuator mechanism cooperating with the drive shaft.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a partial enlarged schematic view of the metering pump of the invention showing the valve at the beginning of the intake stroke;

FIG. 3 is a similar partial enlarged schematic view of the metering pump of the invention showing the valve at the end of the intake stroke;

FIG. 4 is a similar partial enlarged schematic view of the metering pump of the invention showing the valve at the crossover point beginning the discharge stoke;

FIG. 5 is a similar partial enlarged schematic view of the apparatus of the invention showing the valve at the end of the discharge stroke; and FIG. 6 is a similar partial enlarged schematic view of the apparatus of the invention showing the valve at the beginning of the intake stroke upon completion of a single rotation of the piston.

DESCRIPTION OF THE PREFERRED EMBODIMENT

Figure 1:
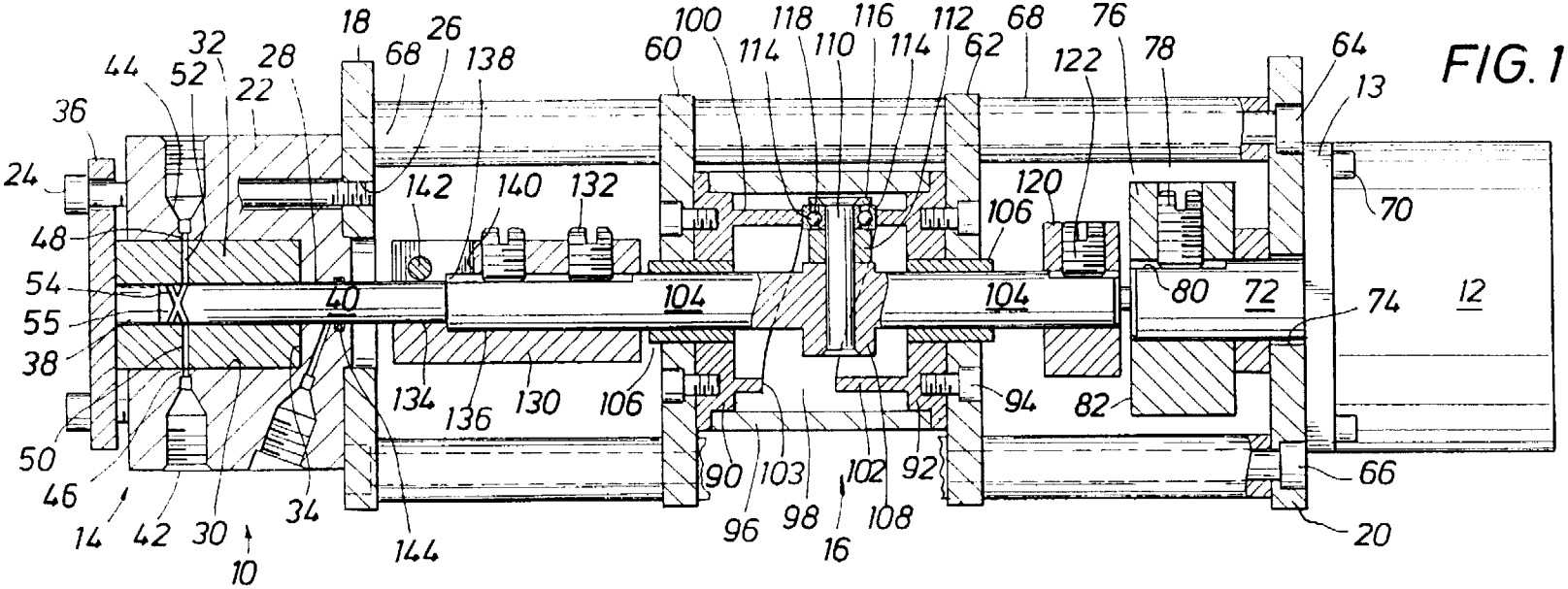
FIG. 1 is a longitudinal sectional view of the metering pump of the invention.

Referring first to FIG. 1, the metering pump apparatus of the invention, generally identified by the reference numeral 10, is shown. One metering pump apparatus 10 is depicted in FIG. 1. It is understood, however, that one or more pump apparatus 10 may be arranged to deliver fluid from a source. For example, two pump apparatus 10 may be arranged 180° out of phase to deliver constant fluid flow from a fluid source to a receiver. The apparatus 10, as shown in FIG. 1, is driven by a motor 12 operatively connected to the pump apparatus 10. The pump apparatus 10 functions to transfer fluid from a source to a receiver at accurately controlled rates and volumes and is capable of dispensing fluid volumes in the nanoliter range.

Referring still to FIG. 1, the apparatus 10 comprises a valveless positive displacement metering pump 14, a rotary/linear motion actuator 16 and a motor 12 mounted in an open framework defined by endplates 18 and 20. The pump 14 comprises a pump housing 22 which is mounted to the endplate 18 by a plurality of screws 24 which extend through the pump housing 22 and are threadably received within holes 26 formed in the endplate 18.

The cylindrical pump housing 22 includes an axial bore 28 and a counter bore 30. A cylindrical pump housing liner 32 is received within the counter bore 30. The one end of the cylindrical liner 32 abuts against a shoulder 34 forming the inner end of the counter bore 30. The opposite end of the liner 32 projects slightly out of the counter bore 30 and is closed by an endcap 36 which is secured against the end face of the liner 32 and mounted to the cylindrical housing 22 by several threaded screws 24. Appropriate O-ring seals or the like (not shown in the drawings) are incorporated at the contact of the endcap 36 with the end face of the liner 32 for forming a fluid tight seal therewith. The liner 32 is provided with an axial passage 38 for slidably and rotatably receiving a piston 40 therein.

The cylindrical housing 22 is provided with diametrically opposite, internally threaded fluid ports 42 and 44. The ports 42 and 44 taper inwardly terminating in radial passages 46 and 48. The radial passages 46 and 48 have smaller diameters than the ports 42 and 44 and extend through the cylindrical housing 22 to the counter bore 30. The radial passages 46 and 48 are in alignment with radial passages 50 and 52 formed within and extending through the cylindrical liner 32. The diameters of the passages 50 and 52 are equal to the diameters of the radial passages 46 and 48 and are sized for mating alignment with crossover slots 54 and 55 formed on the piston 40 and which slots will be described in greater detail later herein.

As noted above, the pump apparatus 10 of the invention comprises three primary components: the positive displacement pump 14, the cam actuator 16, and the motor 12. These three components are supported in axial alignment by end plates 18 and 20. The support framework further includes flange members 60 and 62 which are coupled to the end plates 18 and 20 by mounting bolts 64 and 66, which collectively form the open framework structure of the pump apparatus 10. The spacing between the end plates 18 and 20 is maintained by cylindrical spacers 68 journaled about the mounting bolts 64 and 66 as shown in FIG. 1.

The motor 12 is mounted to the end plate 20 by mounting screws 70 which extend through a circumferential mounting flange 13 of the motor 12 and are threadably received within threaded holes formed in the endplate 20. A rotor shaft 72 projects from the motor 12 through an opening 74 in the end plate 20. A cylindrical drive shaft coupling 76 is mounted about the rotor shaft 72 and is coupled thereto by a set screw 78 which extends through the coupling 76 and engage a flat face 80 formed on the rotor shaft 72. Projecting from the flat planar surface 82 of the coupling 76 are a pair of drive coupling pins 84 ( best shown in FIG. 1A).

Referring now to the cam actuator 16 supported axially between the motor 12 and the pump 14, the cam actuator 16 comprises flanged cylindrical end members 90 and 92 threadably mounted to support frame members 60 and 62, respectively, by the mounting screws 94. The flanged end members 90 and 92 are mounted on opposite ends of a cylinder 96, which when assembled with the end members 90 and 92, defines a cam chamber 98. The end members 90 and 92 are provided with cylindrical extensions 100 and 102 projecting toward each other and forming a cam passageway or track 103 therebetween.

A cam drive shaft 104 extends through the cam chamber 98 and through axial bores formed in the end members 90 and 92 and the support frame members 60 and 62. Bushings 106 extending through the axial bores of the end members 90 and 92 and the support frame members 60 and 62 are journaled about the cam shaft 104. The internal diameters of the bushings 106 are sized so that the cam shaft 104 may rotate and reciprocate freely in the bushings 106.

The cam shaft 104 includes an enlarged portion 108 formed at about the midpoint of the cam shaft 104. The enlarged portion 108 is provided with an axial opening extending perpendicular to the rotational axis of the cam shaft 104 for receiving a connector pin 110 therethrough. A spacer 112 mounted about the connector pin 110 provides a support shoulder for a ball bearing retainer ring 114. An internal, flanged retainer ring 116 cooperates with the ring 114 for forming a raceway for ball bearings 118 received between the rings 114 and 116. The flanged retainer ring 116 is internally threaded for coupling with the connector pin 110. The retainer ring 114 is sized to travel in the cam track 103 defined between the cylindrical extensions 100 and 102 of the cam actuator end members 90 and 92. The ring 114 is guided between the facing shoulders defining the cam track 103 so that cam shaft rotation is converted into linear actuation. Linear travel is accommodated while sustaining the connected arrangement to be detailed.

Figure 1A:
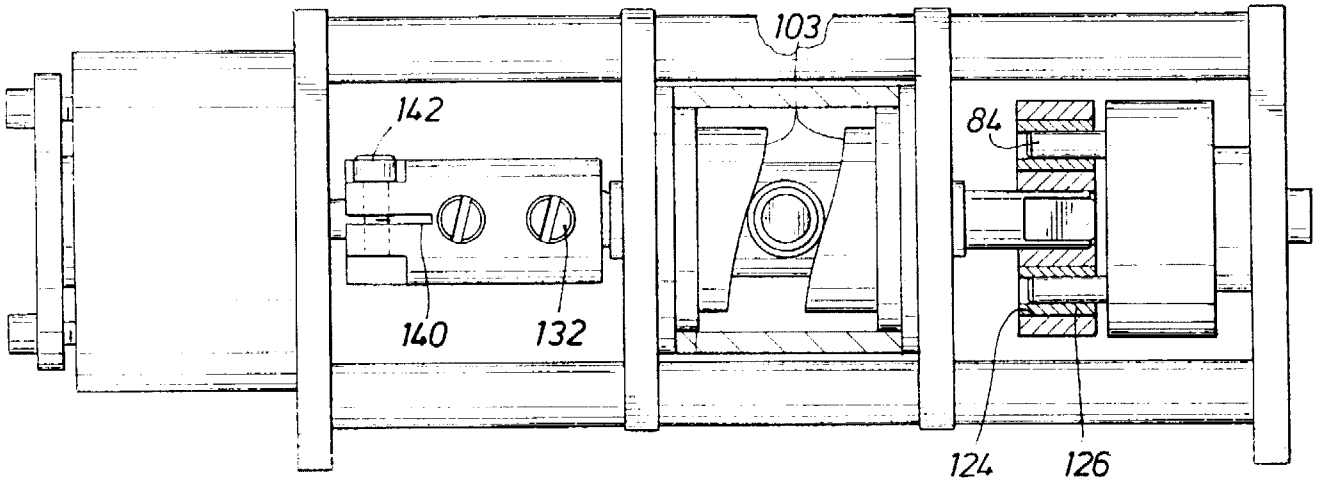
FIG. 1A is partial sectional top plan view of the metering pump of the invention.

The cam shaft 104 projects outward from each end of the cam actuator chamber 98. A motor coupling 120 is secured to one end of the drive shaft 104 by set screw 122. The coupling 120 is provided with slots 124 extending therethrough (FIG. 1A). Bushings 126 are received within the slots 124 for receiving the pins 84 projecting from the motor drive coupling 76. The bushings 126 slide freely on the pins 84, thereby permitting the pins 84 to move longitudinally during reciprocal movement of the cam shaft 104 while simultaneously imparting rotational movement to the cam shaft 104 through the motor coupling 120.

Moving toward the left end of the cam shaft 104, a piston coupling 130 is secured to the end of the cam shaft 104 by set screws 132. The coupling 130 includes an axial bore 134 and an axial counter bore 136. The end of the cam shaft 104 abutts against a circumferential shoulder 138 of the counter bore 136. The distal end of the piston 40 is received in the axial bore 134 and abutts against the end of the cam shaft 104. The end of the coupling 130 is partially slotted at 140 so that the coupling 130 may be clamped about the end of the piston 40 by tightening up the clamp screw 142 for mechanically connecting the piston 40 to the cam shaft 104.

Upon assembly of the components of the apparatus 10 shown in FIG. 1, the proximal end of the piston 40 projects through the bore 28 of the pump housing 22 and into the liner 32. Sealing about the piston 40 is accomplished by use of an O-ring 144 received in a circumferential recess formed in the axial bore 28 of the pump housing 22.

Referring again to FIG. 1, it will be observed that the piston 40 of the invention is provided with helical slots 54 and 55 which crisscross each other. The helical slots 54 and 55 are etched into a portion of the surface of the piston 40 which may be formed of ceramic material or any other suitable materials. The helical slot 54 includes an angularly extending slot portion 57 which extends to the end face of the piston 40 as best shown in FIG. 2.

As a result of the geometric form of the slots 54 and 55, fluid pumping is accomplished in accordance with the sequence shown in FIGS. 2–6. In FIGS. 2–6, the piston 40 is shown with the outer face flattened so that the slots are flattened also. The ports into the slots are shown. For purposes of discussion, the passage 50 extending through the liner 32 is in fluid communication with inlet port 42 formed in the pump housing 22. Liner passage 52 is in fluid communication with the discharge port 44. The inlet port 42 and discharge port 44 are directly opposite each other, 180° apart, on the cylindrical pump housing 22. The piston 40 and the cylindrical liner 32 are machined to provide a liquid tight seal therebetween.

Upon actuation of the motor 12, the piston 40 rotates in the clockwise direction relative to the orientation of the pump 10 as shown in FIG. 1. Upon rotation, the piston 40 is simultaneously retracted by the cam shaft 104 which is pulled backward as the cam ring 114 moves along the cam passageway 103. In the position shown in FIG. 2, the inlet passage 50 is open to the helical slot 55. As the piston 40 is rotated, fluid enters the slots 54 and 55 and flows in the direction of the arrows shown in FIG. 2 and fills the piston chamber 150 (FIG. 3). Filling is discussed first and pumping is discussed later. The simultaneous rotation and retraction of the piston 40 maintains the fluid passage 50 in alignment with the helical slot 55 so that fluid flows into the piston chamber 150 (FIG. 3). Retraction and rotation of the piston 40 during the rotational alignment of the helical slot 55 with the fluid passage 50 is accomplished by the travel of the cam shaft cam ring 114 in the cam track 103 in the direction of the arrow shown in FIG. 3. FIGS. 2–6 show the cam track 103; in the guided connection, the track 103 directs the pin 110 (using the ball bearing assembly) to move the cam mechanism in converting linear motion to rotation. As the cam ring 114 travels along the cam track 103, the cam shaft 104 retracts toward the motor 12 (to the right) thereby retracting the piston 40 within the cylindrical liner 32 and opening the chamber 150 toward its maximum volume.

Referring now to FIG. 3, it will be observed that upon rotation of the cam shaft 104 through 180°, the piston 40 has reached its maximum retracted position and the inlet passage 50 is aligned with the end of the slot 55. Rotation of the cam shaft 104 another 30°, from 180° to 210°, positions the outlet passage 52 in alignment with the slot 54 as shown in FIG. 4. FIG. 4 conveniently adds a set of angular calibrations to enhance the discussion of rotation and related alignment of ports to the illustrated slots. The piston 40 however does not move axially during this 30° rotation because the cam track 103 includes a segment 105, through 30° of rotation, which is perpendicular to the rotational axis of the cam shaft 104 thereby enabling the piston 40 to be rotated for alignment with the outlet passage 52 (compare FIG. 3 to FIG. 4) but remaining axially stationary.

Further rotation of the cam shaft 104 from 210° to 330° (note calibration marks in FIG. 4) changes the direction of axial travel of the cam shaft 104 toward the pump 14, which simultaneously advances the piston 40 into the piston chamber 150 and forces the fluid in the piston chamber 150 to be discharged through the discharge passage 52 as shown in FIGS. 4 and 5. During rotation of the piston 40 from 210° through 330°, the discharge passage 52 is in rotational alignment with the helical slot 54 providing a fluid passage for discharging fluid to a receiver. At the end of the discharge stroke, the inlet passage 50 is offset by 30° from the helical slot 55 as shown in FIG. 5. Rotation of the piston 40 through 360° aligns the inlet passage 50 with the helical slot 55 as shown in FIG. 6 and the suction/discharge cycle is repeated. Again, the piston 40 does not move axially during the 30° rotation of the piston 40 between 330° and 360° because the cam track 103 includes a second segment 107, through 30° of rotation, which is perpendicular to the rotational axis of the cam shaft 104 thereby enabling the piston 40 to be rotated for alignment with the inlet passage 50 but remaining axially stationary. Thus, no pressure build up occurs in the piston chamber 150 when both the inlet passage 50 and the outlet passage 52 are closed by the piston 40 as it is rotated to complete the suction/discharge cycle.

While the foregoing is directed to the preferred embodiment of the present invention, other and further embodiments of the invention may be devised without departing from the basic scope thereof, and the scope thereof is determined by the claims which follow.

What is claimed is:

1. A metering pump comprising:

(a) a closed end cylindrical pump housing including a first fluid port means for allowing fluid to flow into and a second fluid port means for allowing fluid to flow out of said cylindrical housing;

(b) piston means in said cylindrical housing to define with said cylindrical housing at said closed end a sealed pumping chamber and said piston means moves with reciprocation and rotation in said housing;

(c) wherein said first and second port means open into said sealed chamber;

(d) means for rotating or rotating and reciprocating said piston means for alternately supplying fluid to said sealed pumping chamber and discharging fluid from said pumping chamber through said first and second port means wherein said piston means periodically dwells between movements thereof; and (e) surfaces on said piston means moving with said piston means to positions relative to said first and second port means to sequentially meter fluid into said pumping chamber to fill said chamber from said first port means and discharge said chamber to meter fluid to said second port.

2. The pump of claim 1 wherein said surfaces on said piston means comprise a pair of crossing slots on said piston means, wherein one of said slots is in fluid communication with said pumping chamber.

3. The pump of claim 1 wherein said means for rotating or reciprocating said piston means comprises cam actuator means and motor means operatively connected to said piston means.

4. The pump of claim 3 wherein said cam actuator means comprises a drive shaft connecting said piston means to said motor means, wherein said drive shaft includes cam means connected with said piston means and said motor means for reciprocating said piston means upon rotation of said piston means by said motor means.

5. The pump of claim 4 wherein said cam actuator means further comprises a cam housing enclosing a cam shaft cooperating with said drive shaft, and a cam track which is cooperatively spaced from said cam shaft and wherein said cam shaft comprises a retainer ring which is sized to travel within said cam track, and said cam track cooperating with said retaining ring provides means for controlling axial movement of said drive shaft and also permitting rotational movement of said drive shaft.

6. A metering pump comprising:

(a) a closed end cylindrical pump housing including fluid port means for allowing fluid to flow into and out of said cylindrical housing;

(b) piston means movable by reciprocating and rotating, or rotating in said cylindrical housing and defining with said cylindrical housing at said closed end a sealed pumping chamber, said piston means including crisscrossed helical slot means formed on said piston means;

(c) said fluid port means comprising at least two ports within said cylindrical housing selectively alignable with said slot means; and (d) means for simultaneously rotating and reciprocating said piston means to form alternating piston means strokes interrupted by periodic dwell periods for alternately supplying fluid to said pumping chamber and separately discharging fluid from said pumping chamber.

7. The pump of claim 6 wherein said helical slot means comprises a pair of crisscrossed helical slots on said piston means, wherein one of said crisscrossed slots is in fluid communication with said pumping chamber.

8. The pump of claim 1 wherein said surfaces on said piston means include:

(a) a flow path defined thereby directing fluid from first port means into said sealed pumping chamber;

(b) a second flow path from said sealed pumping chamber to said second port means; and (c) sealing surfaces preventing flow through said first and second port means simultaneously.

9. The pump of claim 8 wherein said piston means moves to sequential connection of said sealed pumping chamber to said first port means to fill said pumping chamber and separately to said second port means to empty said pumping chamber.

10. A method of pumping a metered volume of fluid comprising the steps of:

(a) providing a suction stroke by retracting a piston sealed in a pump chamber to draw fluid into said chamber from a supply port opening through a cylinder wall;

(b) after drawing fluid into said pump chamber, providing a discharge stroke by forcing fluid from said pump chamber by moving said piston in said cylinder to force fluid through an outlet port opening through said cylinder wall;

(c) providing a dwell period between said suction and said discharge strokes;

(d) rotating in sequenced movement said piston on said cylinder wall to selectively blank said supply port during said discharge stroke; and (e) rotating in sequenced movement said piston in said cylinder wall to selectively blank said outlet port during said suction stroke.

11. The method of claim 10 including the step of forming on said piston a surface which rotates to blank at least one of said ports at a given moment, and including the step of rotating said piston during said dwell period between first and rotational positions to achieve repetitive filling and forcing fluid from said pump chamber.

12. The method of claim 10 including the step of connecting a motor to an elongate rod connected to said piston to rotate said piston wherein rotation provides the sequenced movement of step 10(d)or step 10(e).

13. The method of claim 10 including the step of connecting a motor to a cam mechanism to move said piston in linear motion to provide the movement of step 10(a) or 10(b).

14. The method of claim 12 including the step of connecting a motor to a cam mechanism to move said piston in linear motion to provide the movement of step 10(a) or 10(b).

15. The method of claim 13 including the step of connecting a motor to an elongate rod connected to said piston to rotate said piston wherein rotation provides the sequenced movement of step 10(d) or step 10(e).

16. The method of claim 10 wherein:

(a) said piston is moved by an elongated piston rod connected thereto;

(b) said piston is reciprocated and rotated corresponding to the reciprocation and rotation of said rod; and (c ) said steps of claim 10 are done in a respective sequence of:

(1) reciprocating and rotating said rod during the suction stroke, (2) rotating said rod during said dwell period, such that no reciprocation occurs, and (3) reciprocating and rotating said rod during the discharge stroke.

17. The method of claim 16 including the step of reciprocating and rotating by specific amount to controllably pump repetitively.

18. The method of claim 17 including the step of closing said supply and outlet ports with said piston.

19. The method of claim 18 including the step of rotating by a cam surface.

* * * * *